United States Patent [19]

Shealy

[11] Patent Number: 4,535,663

[45] Date of Patent: Aug. 20, 1985

[54] APPARATUS FOR REMOVING CUT STAPLE

[75] Inventor: James B. Shealy, Irmo, S.C.

[73] Assignee: Allied Corporation, Morris Township, Morris County, N.J.

[21] Appl. No.: 500,610

[22] Filed: Jun. 2, 1983

[51] Int. Cl.[3] ..... D01G 1/04

[52] U.S. Cl. ..... 83/100; 83/346; 83/913

[58] Field of Search ..... 83/98–100, 83/346, 347, 402, 913, 24, 37

[56] References Cited

U.S. PATENT DOCUMENTS

| | | | |
|---|---|---|---|
| 2,607,418 | 8/1952 | Hebeler . | |
| 3,485,120 | 12/1969 | Keith | 83/37 |
| 3,733,945 | 5/1973 | Cook | 83/99 X |
| 3,861,257 | 1/1975 | Laird et al. | 83/22 |
| 3,915,042 | 10/1975 | Laird | 83/346 X |
| 3,945,280 | 3/1976 | Roncato | 83/98 |
| 3,948,127 | 4/1976 | Vehling et al. | 83/346 X |
| 3,985,053 | 10/1976 | Kayser | 83/913 X |
| 4,014,231 | 3/1977 | Hutzezon | 83/913 X |
| 4,120,222 | 10/1978 | Potter | 83/99 |
| 4,369,681 | 1/1983 | Van Doorn | 83/100 |

*Primary Examiner*—James M. Meister

*Attorney, Agent, or Firm*—Virginia S. Andrews

[57] ABSTRACT

Method and apparatus for removing cut staple from a reel type staple cutter are disclosed. The apparatus features a tub connected to the mounting member of the cutter reel. An air flow is created across the tub adjacent to the fiber doffing point and cutter reel, parallel to the plane of the cutter reel, to remove the cut staple as quickly as possible. The ratio of the cutter reel diameter to the tub depth varies from 0.85–4.8 to 1.

4 Claims, 6 Drawing Figures

APPARATUS FOR REMOVING CUT STAPLE

BACKGROUND OF THE INVENTION

1. Field of the Invention

The present invention relates to apparatus for cutting elongated filamentary material into shorter lengths and to method and apparatus for quickly and uniformly removing the cut material. More particularly, the invention relates to the regulation of air flow immediately beneath the doffing point of a staple cutter for nylon tow to achieve adequate yarn separation to permit the yarn to open properly in a subsequent carding process.

2. The Prior Art

Cutters as described by Keith in U.S. Pat. No. 3,485,120, hereby incorporated by reference, are broadly used for cutting tow into staple length fibers. These cutters include a rotatable reel having outwardly facing cutter blades against which the tow is wound and a fixed pressure roller pressing upon the tow wound around the reel resulting in cutting of the innermost layers of tow by the cutter blades. As cutting progresses a wad of cut staple fiber is forced inwardly between adjacent pairs of blades. Unfortunately, centrifugal forces and interfiber adhesion resist removal of wads of cut fibers by gravitational forces. Thus, the wads of cut fibers continue to rotate with the reel and continue to increase in size until either the cutter jams or until ropes or chips of cohered staple break off from the wads and fall into the collection hopper. These ropes or chips are heavily entangled, difficult to open, and cause subsequent difficulties in mill processing, such as carding.

Cook in U.S. Pat. No. 3 733 945, hereby incorporated by reference, recognizes the problem associated with the Keith cutter and resolves the problem by mounting at least one fixed jet so that it jets air downwardly upon the proximity of the doffing point of the cut fiber through aligned apertures in the cutting reel which rotate past the jet. This assists the gravitational forces in overcoming the effect of centrifugal and fiber-to-fiber forces allowing the cut fiber to fall freely downward. Cook also discloses several unsuccessful attempts to remove the cut staple, which include: inserting an air jet at the center point of the cutting reel directed outwardly so to impinge upon the pressure roll; placing a jet at the top of the chute directed inwardly at the vertical axis of the cutter; placing a plurality of jets around the circumference of the top of the chute, all directed inwardly of the vertical axis of the cutter; and inserting holes in the side of the chute and placing air jets therein directed to the vertical axis of the cutter and subsequently at a 45° angle so as to be directed inwardly towards the interior of the cutting reel.

Potter in U.S. Pat. No. 4,120,222, hereby incorporated by reference, modifies the reel-type cutter of Cook so that the jet-producing orifices rotate with the reel and do not interrupt jet air flow as in Cook to reduce the noise level of the Cook arrangement.

Kayser et al. in U.S. Pat. No. 3,985,053, hereby incorporated by reference, utilizes a radial blower to avoid twist formation at the cutter. The radial blower is aligned with its suction opening as close as possible to the cutting point, care being taken that at least the major portion of the intake air flows from one or from combined cutting points. The blades of the blower rotor leave a space between fan blades and the inside wall of the housing corresponding to at least half of the effective knife lengths of the cutting point of the staple cutter preceding the radial blower.

Laird in U.S. Pat. Nos. 3,861,257 and 3,915,042, both of which are hereby incorporated by reference, discloses cutters the blades of which may face inwardly or outwardly. After the tow is cut it is forced radially outwardly into an annular chamber which surrounds the cutter reel and is connected to ductwork leading to the feed end of a blower. Openings are provided inwardly of the ring of cutter blades for admission of fluid such as air into the suction chamber. Thus, the blower draws air into the annular chamnber causing the air to flow radially outwardly through the spaces between the blades, entraining the cut fibers and carrying them through the ductwork and through the blower and outlet duct into a collection chamber.

Vehling et al. in U.S. Pat. No. 3,948,127, hereby incorporated by reference, provides apparatus for severing a continuous tow comprising a first cage around which the tow wraps and a second cage including a plurality of knives forming an annulus around the tow, the outermost convolutions of the tow being displaced radially outwardly to move into the range of and be severed by the cutting edges of the knives. The severed filaments are preferably withdrawn radially outwardly through the spaces between the knives by a suction chamber a portion of which surrounds the second cage.

Roncato in U.S. Pat. No. 3 945 280, hereby incorporated by reference, supplies compressed air to the spaces between cutting blades on a rotating drum to remove waste material resulting from the cutting of a tow carried by a rotating support drum operating in conjunction with the cutting blades.

Another cutter which utilizes air for staple removal is Hebeler in U.S. Pat. No. 2,607,418, hereby incorporated by reference. The present invention is an effective, alternate solution to the problem of cut staple removal.

SUMMARY OF THE INVENTION

The present invention provides improvements in method and apparatus for cutting filamentary material into predetermined lengths.

In the method for cutting filamentary material into predetermined lengths comprising continuously feeding the filamentary material into successive wraps to a plurality of knife edges secured to a reel having a mounting member and extending a layer of the material across and in contact with adjacent knife edges, applying a pressure against the material to force the layer against the knife edges to thereby sever the material and force it between adjacent knife edges to a doffing point, the improvement comprises: removing the shorter lengths away from the knife edges by creating an air flow adjacent to the doffing point and cutter reel, parallel to the plane of the cutter reel.

The term "doffing point" is a term well-known in the art and refers to a natural point wherein gravitational forces overcome the combined effect of fiber-to-fiber force and centrifugal force to allow the cut fiber to freely fall downwardly through a chute or other escape passage.

Although air is the desired flow medium, any inert gaseous medium may be employed so long as it does not affect the properties of the material being cut. Because of economics and ease of handling, air is the preferred gaseous medium.

The method and apparatus of the invention is particularly useful in processing nylon tow; however, the present invention may be employed on any organic fiber, including nylon, polyester, polyolefins, aramids, glass, etc.

The preferred blade orientation is as shown in the Keith patent, i.e., with the sharp edge of the blade directed radially outward; the method and apparatus of the present invention would also have utility with apparatus having an inward blade orientation. The air flow is 2500 to 6000 cubic feet per minute, hereafter cfm (1.2–2.8 cubic meters per second, hereafter $m^3/s$), more preferably, 4000–6000 cfm (1.9–2.8 $m^3/s$). It is also preferred that the plane of the cutter reel be substantially horizontal, so that the air flow created is immediately beneath the doffing point (and cutter reel).

In an apparatus for cutting filamentary material into predetermined lengths comprising a cutting assembly including a plurality of knife edges secured to a reel having a mounting member and having means adapted to receive successive wrappings of filamentary material to be cut in contact with the plurality of knife edges and means for forcing the material in contact with the knife edges to thereby sever the material and force it between adjacent knife edges to a doffing point, the improvement comprises means for removing the severed material. The means comprises a tub connected to the mounting member, the ratio of the cutter reel diameter to the depth of the tub ranging from 0.85–4.8 to 1; and means for creating an air flow across the tub adjacent to the doff point and cutter reel, parallel to the plane of the cutter reel, to a collection point.

The cutter reel diameter is the diameter of the circle defined by the cutting edge of the plurality of knife edges. The ratio of the cutter reel diameter to the depth of the tub preferably ranges from 0.85 to 2.4 to 1, more preferably 0.94–2.0 to 1, most preferably 1.3 to 1.

It is preferred that the means for creating an air flow across the tub comprises means for communicating with an air source and a fan. The means delivers air from the air source to the tub adjacent to the contact point of the filamentary material and the means for forcing the filamentary material in contact with the knife edges, responsive to the suction induced by the fan through a duct in communication with the tub. The means for communicating with an air source can be an opening in the tub to the atmosphere or a second duct. When using a heavy denier product on the order of 100,000 to 1,200,000 denier preferred dimensions on the ducts are as follows: the duct communicating with the fan has an effective inner diameter of 10 to 12 inches (25–30 cm), and the second duct has an effective inner diameter of 6 to 10 inches (15 to 25 cm) and opens to the atmosphere. An irregularly shaped duct or duct having a larger diameter but with a damper to constrict the size of the duct may be used; that is why the inner diameter is referred to as the effective inner diameter.

DESCRIPTION OF THE PREFERRED EMBODIMENT

Figure 1:
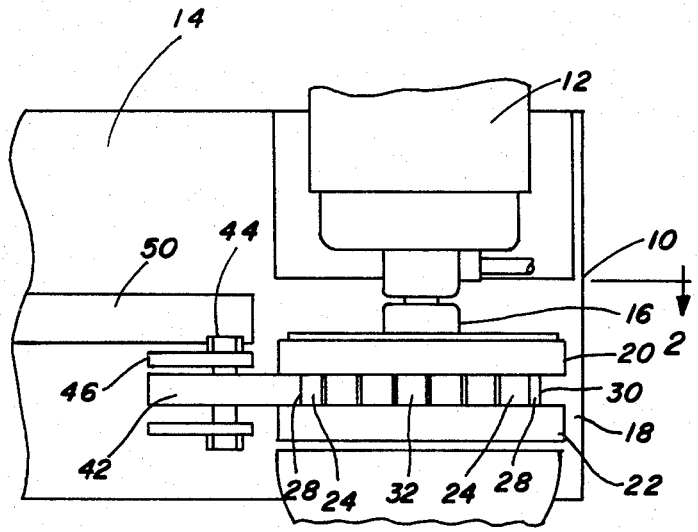
FIG. 1 is a side elevational view of a cutting apparatus according to the present invention.

Reference numeral 10 generally designates cutting apparatus including driving motor 12 mounted on base 14 with its output shaft 16 connected to cutting reel or assembly 18.

Figure 2:
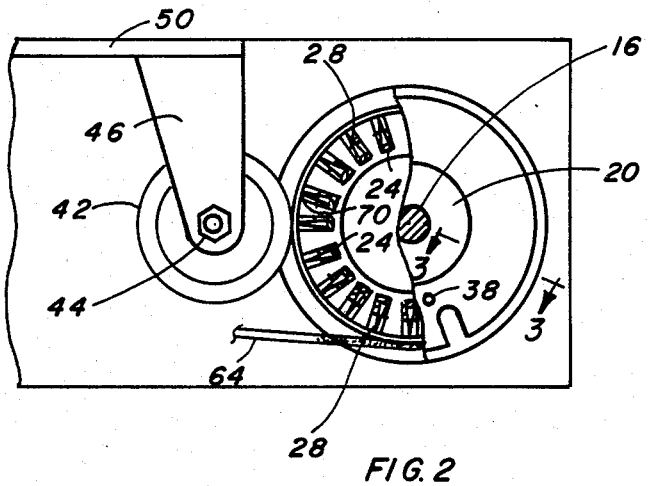
FIG. 2 is a view taken along line 2—2 of FIG. 1.
Figure 3:
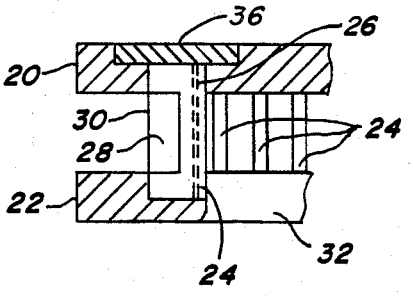
FIG. 3 is an enlarged detailed fragmentary view taken along lines 3—3 of FIG. 2.

Cutting reel or assembly 18 consists of a mounting member including a disk 20, to which the output shaft 16 is removably connected, and mounting ring 22, both of which are formed of generally flat plates of suitable material. As shown in FIG. 3, mounting disk 20 and mounting ring 22 are secured together in spaced, parallel relationship by a plurality of rods 24 which are secured in position by a mechanical fastener (unshown). A groove 26 extends through both mounting disk 20 and mounting ring 22 as well as each rod 24. As shown in FIG. 2, rods 24 are normally secured between mounting disk 20 and mounting ring 22 at equal distances radially outwardly from shaft 16, which also defines the axis of rotation of cutting wheel 18. The circumferential spacing between rods 24 is determined by the staple length desired. While the device described is a preferred construction, a configuration in which ring 22 is not secured to mounting disk 20 by rods 24 can be successfully utilized when the material to be cut is not excessively heavy, and the clamped knife blades 28 are the only structural tie between disk and ring.

The preferred manner of mounting the knife blades 28 is illustrated in FIG. 3. As shown therein knife blades 28 are removably mounted or inserted in grooves 26 of rods 24 with cutting edge 30 extending radially outward. Since rods 24 are disposed radially from output shaft 16 and the axis of rotation of cutting assembly 18, knife blades 28 are likewise disposed. The width of blades 28 from cutting edge 30 to back is substantially less than the radial distance from the axis of rotation of cutting reel 18 to the edge 30. Thus, mounting disk 20, mounting ring 22 and rods 24 in which blades 28 are supported form an open ended compartment 32 within the cutting reel 18. Item 36 is a blade retainer ring (see FIG. 3).

As best shown in FIGS. 1 and 2, a pressure applicator 42 of the rotatable type such as wheel or roller is mounted on a shaft 44 secured to a bifurcated bracket 46 which in turn is supported on a spring loaded pivot arm 50 attached to the cutter frame (unshown).

The incoming filamentary tow, which has been flattened into a tape 64 with a tension stand (unshown), is fed to tow guide 66 into the rotating cutting reel 18 and wrapped therearound between mounting disk 20 and mounting ring 22. Thus, as shown in FIG. 2, the tow is in touch contact with cutting edges 30 on knife blades 28 which form the bottom of reel 18. Tow 64 is wrapped upon itself in layers until the distance between knife edges 30 and pressure roll 42 is filled. As the cutting reel 18 rotates under the influence of motor 12 or other drive means, the feed of filamentary tow 64 continues causing pressure to build up within a chamber defined by pressure roll 42, mounting disk 20, mounting ring 22 and adjacent knife edge 30, which, at a point in time, is closest to pressure roll 42. This pressure chamber is shown in FIG. 2 and identified by reference numeral 70. It is to be understood, however, that this pressure chamber 70 is formed with any knife edge 30 as the cutting reel 18 rotates, not just the particular chamber identified in FIG. 2. The pressure continues to mount in magnitude until some of the filaments will be forced to escape the pressure chamber at the point where the highest unit pressure exists between the chamber confines and the filamentary pack inself. The escape route is past the minutely small area of the cutting edge itself. Hence an inward portion of the filamentary pack approximately equal to the feed of the oncoming band of tow 64 is cut as each succeeding cutting edge 30 passes pressure roll 42. The remainder of the pack formed by the several layers will be held firmly against the cutting edges 3 trapped by several tensioned outer layers, to be cut in turn as the pressure again rises in the before described chamber. As the tow 64 is severed the staple fibers pass between knife edges 30 into the open ended compartment 32.

Figure 4:
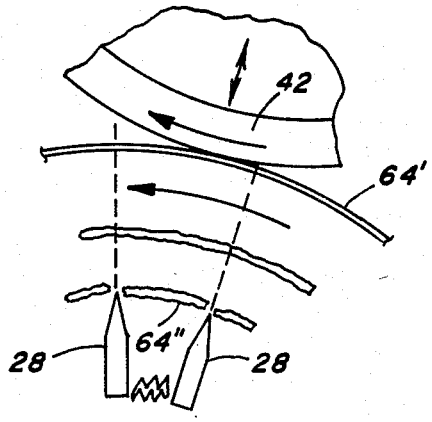
FIG. 4 is an enlarged, fragmentary, detailed view showing the relationship beween the blades, the material being severed and the pressure applicator at the point of cutting.
Figure 5:
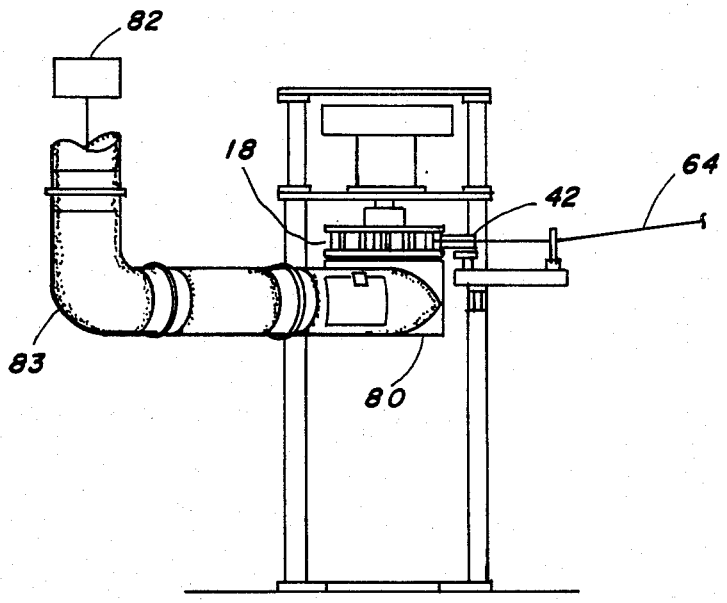
FIG. 5 is a side view of the cutting assembly modified according to the present invention.

The apparatus described thus far is a cutting apparatus substantially as disclosed by Keith in U.S. Pat. No. 3,485,120. The details of the method of cutting are shown in FIG. 4 and described in the Keith patent at column 7. Details of the present invention follow.

Figure 6:
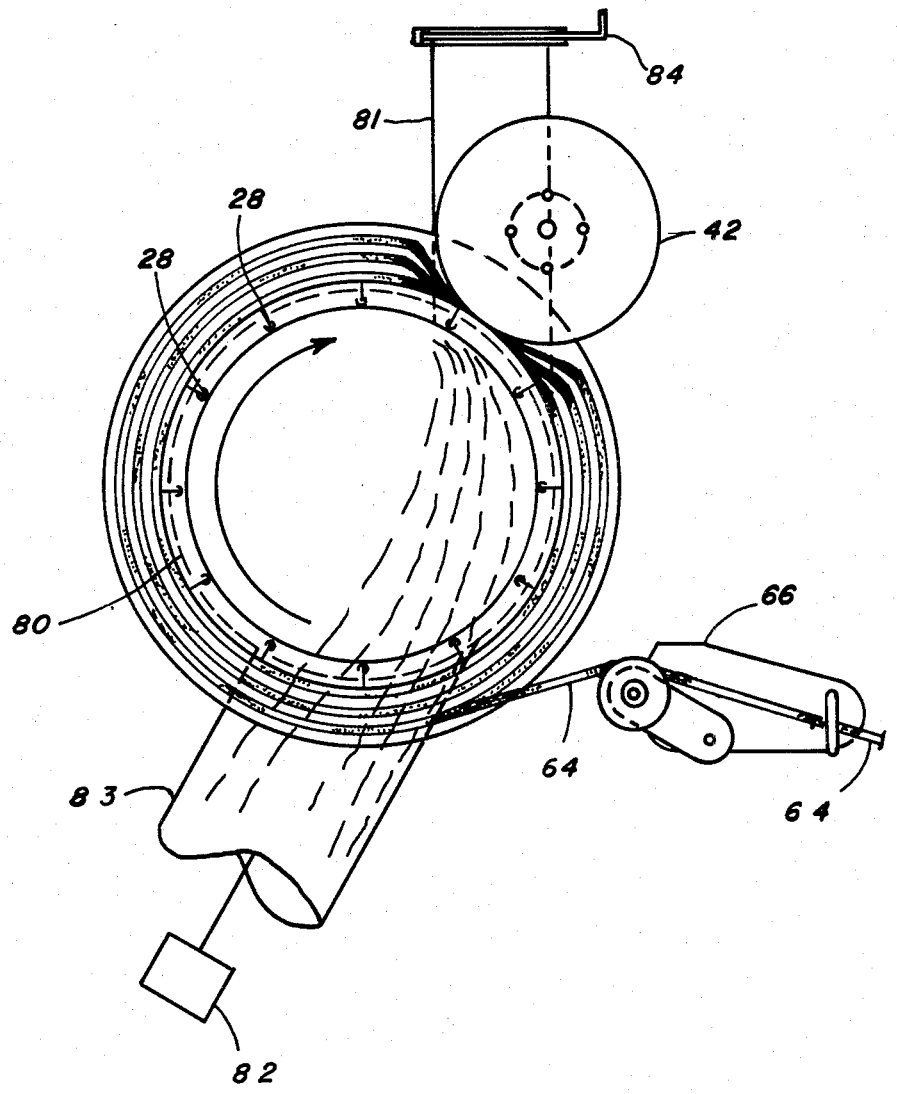
FIG. 6 is a plan view of the cutting assembly modified according to the present invention.

A tub 80 is connected by clamps (unshown) to the lower mounting member, ring 22. Tub 80 is in the form of a right circular cylinder closed at its base and open beneath cutter reel 18. The ratio of cutter reel 18 diameter to tub 80 depth varies from 0.85–4.8 to 1, preferably 0.85–2.4 to 1, more preferably 0.94–2.0 to 1, and most preferably 1.3 to 1. For heavier denier products (see the example) the cutter reel may vary in diameter from 17 to 48 inches (43 to 120 cm) more preferably 17 to 24 inches (43 to 61 cm). The tub depth may vary from 10 to 20 inches (25 to 51 cm), most preferably 12 to 18 inches (30 to 46 cm). With reference to FIG. 6 the air intake duct 81 with damper 84 delivers air from the atmosphere (beyond damper 84) to tub 80 adjacent to and beneath the contact point of tow 64 and pressure roll 42, responsive to suction induced by fan 82 through duct 83 in communication with tub 80. The effective inner diameter of duct 81 for heavy denier product may vary from 6 to 20 inches (15–25 cm). Duct 81 could be eliminated and an opening left in tub 80 where duct 81 would intersect with tub 80. Duct 83 has an effective inner diameter for a heavy denier product of 10–12 inches (25–30 cm). With fan 82 operational to create an air flow of 2500 to 6000 cfm (1.2 to 2.8 $m^3/s$) tow 64 is severed at the contact point between pressure roll 42 and blade 28 when cutter reel 18 rotates (in a clockwise direction, as shown in FIG. 6). As the cut staple reaches its doffing point, air blows just beneath it to sweep the inside wall of tub 80, entrain the cut staple fiber and sweep it into discharge duct 83 to a collection point.

EXAMPLE

The Keith apparatus as described was utilized by running a one million denier nylon 6 tow (about 17 drawn denier per filament) at a speed of about 670 feet per minute (3.4 m/second) to produce a product of variable openness. The product had a quantity of bundles of filaments held together by crimp geometry, finish and/or other fiber to fiber forces which created roping.

The apparatus of this invention was utilized by running 1,077,000 denier nylon 6 tow (about 17 drawn denier per filament) at speeds of about 670 feet per minute (3.4 m/second) and a product of uniform openness was produced. The cutter employed in this example was a Lummus Industries Model Mark 3; the cutter had a radius of 9.0 inches (23 cm) from the center line of the cutter to the circumference of the circle defined by the plurality of sharp knife edges. There were eight knife edges or blades, equispaced to create about a 7-inch cut. With respect to the apparatus of this invention, a Lummus Industries HF Fan F176 located approximately 50 to 60 feet (15 to 18 m) from a tub 80 having an inside diameter of about 20 inches (51 cm) and a depth of about 14 inches (36 cm) was operated to create an air flow of 4,000 to 6,000 cfm (1.9 to 2.8 $m^3/s$) across the tub 80 immediately beneath the doff point (as defined above), which was at a point 45 degrees from the point of cut in the direction of cut material [about 7 inches (18 cm) on circumference from point of cut] and about 15 degrees from the horizontal. The tub 80 was mounted to the lower mounting member of the cutter assembly. The effective inner diameter of the air intake duct was about 6 inches (15 cm), and the inner diameter of the discharge duct was about 10.8 inches (27.4 cm). Air entered the tub beneath the doff point and swept the wall of the tub between the air intake and discharge ducts. There was no roping or clumping of the cut fibers observed.

What is claimed is:

1. In an apparatus for cutting filamentary material into predetermined lengths comprising a cutting assembly including a plurality of knife edges secured to a reel having a mounting member and having means adapted to receive successive wrappings of filamentary material to be cut in contact with the plurality of knife edges and means for forcing said material in contact with the knife edges to thereby sever the material and force it between adjacent knife edges to a doffing point, the improvement comprising means for removing the severed material, said means comprising: (a) a tub connected to the mounting member, the ratio of the cutter reel diameter to the depth of the tub ranging from 0.85–4.8 to 1; (b) means for creating an air flow across the tub adjacent to and beneath the doff point and cutter reel, parallel to the plane of the cutter reel, to a collection point, said means for creating an air flow comprising means for communicating with an air source, said means delivering air from the air source to said tub adjacent to the contact point of said filamentary material and the means for forcing the filamentary material in contact with the knife edges, responsive to the suction induced by a fan through a duct in communication with said tub.

2. The apparatus of claim 1 wherein the duct communicating with said fan has an effective inner diameter of 10 to 12 inches (25 to 30 cm).

3. The apparatus of claim 1 wherein the means for communicating with an air source is a second duct having an effective inner diameter of 6 to 10 inches (15 to 25 cm) and opening to the atmosphere.

4. The apparatus of claim 3 wherein the duct communicating with said fan has an effective inner diameter of 10 to 12 inches (25 to 30 cm) and wherein the ratio of the cutter reel diameter to the depth of the tub ranges from 0.94–2.0 to 1.

* * * * *